US008037924B2

(12) United States Patent
Kido et al.

(10) Patent No.: US 8,037,924 B2
(45) Date of Patent: Oct. 18, 2011

(54) IMMERSION NOZZLE FOR CONTINUOUS CASTING

(75) Inventors: Koji Kido, Kitakyushu (JP); Joji Kurisu, Kitakyushu (JP); Hiroshi Otsuka, Kitakyushu (JP); Arito Mizobe, Kitakyushu (JP); Takahiro Kuroda, Kitakyushu (JP)

(73) Assignee: Krosaki Harima Corporation, Kitakyushu-shi (JP)

( * ) Notice: Subject to any disclaimer, the term of this patent is extended or adjusted under 35 U.S.C. 154(b) by 229 days.

(21) Appl. No.: 12/400,358

(22) Filed: Mar. 9, 2009

(65) Prior Publication Data

US 2009/0242163 A1 Oct. 1, 2009

(30) Foreign Application Priority Data

Mar. 27, 2008 (JP) ..... 2008-084166
Dec. 27, 2008 (JP) ..... 2008-335527

(51) Int. Cl.
*B22D 11/10* (2006.01)

(52) U.S. Cl. ..... 164/437; 164/488

(58) Field of Classification Search ..... 164/437, 164/337, 488

See application file for complete search history.

(56) References Cited

U.S. PATENT DOCUMENTS

| | | | | |
|---|---|---|---|---|
| 4,949,778 | A * | 8/1990 | Saito et al. | 164/468 |
| 2007/0102852 | A1 * | 5/2007 | Richaud et al. | 266/236 |
| 2007/0158884 | A1 * | 7/2007 | Tsukaguchi | 266/236 |

FOREIGN PATENT DOCUMENTS

| | | |
|---|---|---|
| DE | 43 19 194 A1 | 12/1994 |
| JP | 57-106456 | 7/1982 |
| JP | 4-238658 | 8/1992 |
| JP | 7-232247 | 9/1995 |
| JP | 8-294757 | 11/1996 |
| JP | 2001-347348 | 12/2001 |
| WO | WO 2005/049249 A2 | 6/2005 |

OTHER PUBLICATIONS

U.S. Appl. No. 12/400,358, filed Mar. 9, 2009, Kido et al.
U.S. Appl. No. 12/403,120, filed Mar. 12, 2009, Otsuka et al.
Chinese Office Action issued Dec. 24, 2010, in Patent Application No. 200910129821.4 (with English-language translation).

* cited by examiner

*Primary Examiner* — Jessica L Ward
*Assistant Examiner* — Steven Ha
(74) *Attorney, Agent, or Firm* — Oblon, Spivak, McClelland, Maier & Neustadt, L.L.P.

(57) ABSTRACT

An immersion nozzle for continuous casting, including (1) a tubular body with a bottom, the tubular body having an inlet for entry of molten steel disposed at an upper end and a passage extending inside the tubular body downward from the inlet, and (2) a pair of opposing outlets disposed in a sidewall at a lower section of the tubular body so as to communicate with the passage, the nozzle comprising: a pair of opposing ridges horizontally projecting into the passage from an inner wall between the pair of outlets, the inner wall defining the passage.

9 Claims, 21 Drawing Sheets

PRIOR ART

IMMERSION NOZZLE FOR CONTINUOUS CASTING

CROSS REFERENCES TO RELATED APPLICATIONS

This application is based upon and claims benefit of priority of Japanese Patent Applications No. 2008-084166 filed on Mar. 27, 2008 and No. 2008-335527 filed on Dec. 27, 2008, the contents of which are incorporated herein by reference.

BACKGROUND OF THE INVENTION

1. Field of the Invention

The present invention relates to a continuous casting immersion nozzle for pouring molten steel from a tundish into a mold.

2. Description of the Related Art

In a continuous casting process for producing casting steel products of a predetermined shape by continuously cooling and solidifying molten steel, molten steel is poured into a mold through a continuous casting immersion nozzle (hereafter, also referred to as the "immersion nozzle") positioned at the bottom of a tundish.

Generally, the immersion nozzle includes a tubular body with a bottom, and a pair of outlets. The tubular body has an inlet for entry of molten steel disposed at an upper end and a passage extending inside the tubular body downward from the inlet. The pair of outlets are disposed in the sidewall at a lower section of the tubular body so as to communicate with the passage. The immersion nozzle is used with its lower section submerged in molten steel in the mold to prevent flying of poured molten steel into the air and oxidation thereof through contact with the air. Further, the use of the immersion nozzle allows regulation of the molten steel flow in the mold and thereby prevents impurities floating on the molten steel surface such as slags and non-metallic inclusions from being entrapped into the molten steel.

In recent years, there has been a demand for improving the quality and productivity of steel in the continuous casting process. Increasing the productivity of steel with existing production facilities requires rising the pouring rate (throughput). Thus, in order to increase the amount of molten steel that passes through the immersion nozzle, attempts have been made through approaches such as increasing the diameter of the nozzle passage and increasing the dimensions of the outlets within a limited space in the mold.

Increasing the outlet dimensions results in imbalances in flow velocity distribution between the exit-streams discharged out of the lower portions and the exit-streams out of the upper portions of the outlets, and between the exit-stream out of the right outlet and the exit-stream out of the left outlet. The imbalanced flows (drifts) impinge on the narrow sidewalls of the mold and then induce unstable patterns of molten steel flow in the mold. As a result, the level fluctuation at the molten steel surface is caused by excessive reverse flows, and the steel quality is lowered due to entrapment of mold power, and also problems such as breakout occur.

International publication No. 2005/049249, for example, discloses an immersion nozzle including a tubular body, the body having a pair of opposing lateral outlets in the sidewall of a lower section thereof. The lateral outlets each are divided by one or two inward horizontal projections into two or three vertically arranged portions to make a total of four or six outlets (See FIGS. 18A and 18B). International publication No. 2005/049249 describes that the immersion nozzle permits inhibition of clogging and generation of more stable and controlled exit-streams which are more uniform in velocity and in which spin and swirl are significantly reduced.

The present inventors performed water model tests regarding the immersion nozzle of International publication No. 2005/049249, a conventional type immersion nozzle, and a modification of the conventional type immersion nozzle (See FIG. 19), to study variations in the pattern of molten steel flow from each immersion nozzle. The conventional type immersion nozzle includes a tubular body having a pair of opposing outlets in the sidewall at a lower section. The modified type immersion nozzle includes opposing ridges projecting into the passage from the inner surface of the immersion nozzle, the ridges disposed on the middle between the opposing outlets.

FIGS. 20A and 20B show graphs indicating the results of the water model tests regarding the immersion nozzles. In the graph of FIG. 20A, the abscissa represents the average value $\sigma_{av}$ of the standard deviations of the velocities of the reverse flows on the right- and left-hand sides of the immersion nozzle as seen in a view showing the mold's broad sidewall in front, and the ordinate represents the difference $\Delta\sigma$ between the standard deviations of the velocities of the right- and left-hand reverse flows. In the graph of FIG. 20B, the abscissa represents the average value $\sigma_{av}$ of the standard deviations of the velocities of the right- and left-hand reverse flows, and the ordinate represents the average value $V_{av}$ of the velocities of the right- and left-hand reverse flows. In addition, sample A corresponds to the immersion nozzle of International publication No. 2005/049249 (four-outlet type nozzle), sample B corresponds to the conventional type immersion nozzle, and sample C corresponds to the modified type immersion nozzle. FIG. 20A indicates that the conventional type immersion nozzle (sample B) exhibited the largest difference $\Delta\sigma$ between the standard deviations of the velocities of the right- and left-hand reverse flows, namely, the largest difference between the velocities of the right- and left-hand reverse flows, while the immersion nozzle of International publication No. 2005/049249 (sample A) and the modified type immersion nozzle (sample C) exhibited smaller differences between the velocities of the right- and left-hand reverse flows. On the other hand, FIG. 20B indicates that the conventional type immersion nozzle (sample B) and the immersion nozzle of International publication No. 2005/049249 (sample A) exhibited larger average values $V_{av}$ of the velocities of the right- and left-hand reverse flows and that the modified type immersion nozzle (sample C) exhibited the smallest average value $V_{av}$.

The difference $\Delta\sigma$ between the standard deviations of the velocities of the right- and left-hand reverse flows and the average value $V_{av}$ of the velocities of the right- and left-hand reverse flows increase with a rise in throughput. From the viewpoint of improving the quality of slabs, it is desirable that $\Delta\sigma$ is 2 cm/sec or less, and that $V_{av}$ is 10 cm/sec to 30 cm/sec. Note that $\Delta\sigma$ of all the samples were 2 cm/sec or less, while $V_{av}$ of all the samples were outside the range of 10 cm/sec to 30 cm/sec.

In the case of the immersion nozzle of International publication No. 2005/049249 (four-outlet type nozzle), as indicated by the results of the fluid analyses in FIGS. 21A, 21B, larger amounts of the exit-streams issued from the lower portions of the outlets while smaller amounts from the upper portions, with the result that the velocities of the reverse flows were as high as 35 cm/sec. For the fluid analyses, the mold was set to have dimensions of 1500 mm×235 mm and the throughput was set to 3.0 ton/min.

Further, the immersion nozzle of International publication No. 2005/049249, which has four or more outlets, not only requires a complicated manufacturing process, but is liable to induce imbalance between the right- and left-hand exit-streams when clogging or thermal wear of the outlets occurs.

The present invention has been made in view of the above circumstances, and it is an object of the present invention to provide an immersion nozzle for continuous casting which reduces the drift of molten steel flowing from the outlets of the nozzle and reduces the level fluctuation at the molten steel surface and which is easy to manufacture.

SUMMARY OF THE INVENTION

The present invention relates to an immersion nozzle for continuous casting. The immersion nozzle for continuous casting includes a tubular body with a bottom, and a pair of opposing outlets. The tubular body has an inlet for entry of molten steel disposed at an upper end and a passage extending inside the tubular body downward from the inlet. The pair of opposing outlets are disposed in a sidewall at a lower section of the tubular body so as to communicate with the passage. The immersion nozzle for continuous casting further includes a pair of opposing ridges horizontally projecting into the passage from an inner wall between the pair of outlets. The inner wall defines the passage.

The term "ridges horizontally projecting into the passage from an inner wall" as used herein refers to ridges each extending horizontally from one side to the other side in an inner wall, i.e., from one border between one outlet and one side in the inner wall to the other border between the other outlet and the other side in the inner wall.

In the immersion nozzle for continuous casting of the present invention, it is preferable that a/a' ranges from 0.05 to 0.38 and b/b' ranges from 0.05 to 0.5, where a' and b' are a horizontal width and a vertical length, respectively, of the outlets in a front view; a is a projection height of the ridges at end faces; and b is a vertical width of the ridges. Further, it is preferable that c/b' ranges from 0.15 to 0.7, where c is a vertical distance between upper edges of the outlets in a front view and vertical widthwise centers of the ridges.

In the immersion nozzle for continuous casting of the present invention, it is also preferable that the ridges each have tilted portions at opposite ends in a lengthwise direction of the ridges. The tilted portions are tilted downward toward an outside of the tubular body. Additionally it is preferable that each outlet has an upper end face and a lower end face that are tilted downward toward the outside of the tubular body at the same tilt angle as the tilted portions.

In the immersion nozzle for continuous casting of the present invention, further, it is preferable that $L_2/L_1$ ranges from 0 to 1, where $L_1$ is a width of the passage, along a lengthwise direction of the ridges, immediately above the outlets; and $L_2$ is a length of the ridges except the tilted portions.

DETAILED DESCRIPTION OF THE PREFERRED EMBODIMENTS

Figure 1A:
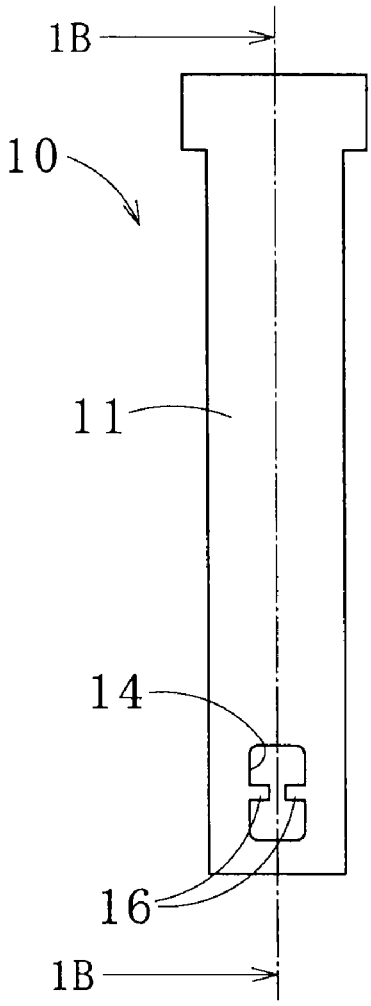
FIG. 1A shows an immersion nozzle for continuous casting according to one embodiment of the present invention.
Figure 1B:
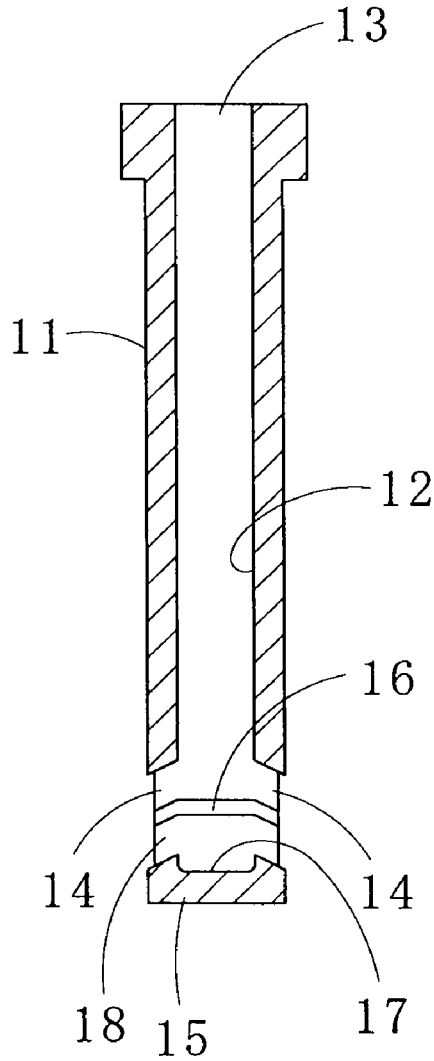
FIG. 1B is a cross-sectional view taken on line 1B-1B of FIG. 1A.

FIG. 1A shows an immersion nozzle for continuous casting (hereafter, also referred to as "immersion nozzle") 10 according to one embodiment of the present invention. Throughout the embodiment, the directions are set with the immersion nozzle 10 arranged upright.

The immersion nozzle 10 includes a cylindrical tubular body 11 with a bottom 15, and a pair of opposing outlets 14, 14. The tubular body 11 has an inlet 13 for entry of molten steel at the upper end of a passage 12 extending inside the tubular body 11. The pair of opposing outlets 14, 14 are disposed at a lower section thereof so as to communicate with the passage 12. The tubular body 11 is made of a refractory material such as alumina-graphite since the immersion nozzle 10 is required to have spalling resistance and corrosion resistance.

The outlets 14, 14 have a rectangular configuration with rounded corners, when seen in a front view. The tubular body 11 has opposing ridges 16, 16 that project in the horizontal direction into the passage 12 from an inner wall 18, which defines the passage 12, between the pair of outlets 14, 14. Namely, the opposing ridges 16, 16 are arranged symmetrically about a vertical plane passing through the centers of the respective outlets 14, 14 (shown in the chain double-dashed line in FIG. 1A). The ridges 16, 16 are of a substantially rectangular cross section. The term "substantially rectangular cross section" is intended to cover a rectangular cross section with rounded corners. The clearance between the ridges 16, 16 is constant. Each ridge 16 has tilted portions 16*a*, 16*a* at the opposite ends in the lengthwise direction thereof, which are tilted downward toward the outside of the tubular body 11 (See FIGS. 3A and 3B). The lengthwise direction of the ridges 16, 16 refers to a direction along a line passing through the centers of the respective outlets 14, 14. Each outlet 14 has an upper end face 14*a* and a lower end face 14*b* that are tilted downward toward the outside of the tubular body 11. In this embodiment, the tilted portions 16*a*, 16*a* and the upper end face 14*a* and lower end face 14*b* are tilted at the same tilt angle.

If each outlet 14 has the upper end face 14*a* and lower end face 14*b* tilted downward toward the outside of the tubular body 11 but the ridges 16, 16 are not tilted downward at the opposite ends in the lengthwise direction, the exit-streams to flow through the spaces above the ridges 16, 16 are interrupted by the ridges 16, 16. As a result, the exit-streams are discharged out of the outlets 14, 14 upward. The exit-streams thus discharged collide with the reverse flows at the molten steel surface in the mold, destabilizing the velocities of the reverse flows. For this reason, the tilted portions 16*a*, 16*a* at the opposite ends of each ridge 16 in the lengthwise direction are tilted at the same tilt angle as the upper end face 14*a* and lower end face 14*b* of each outlet 14.

Figure 3B:
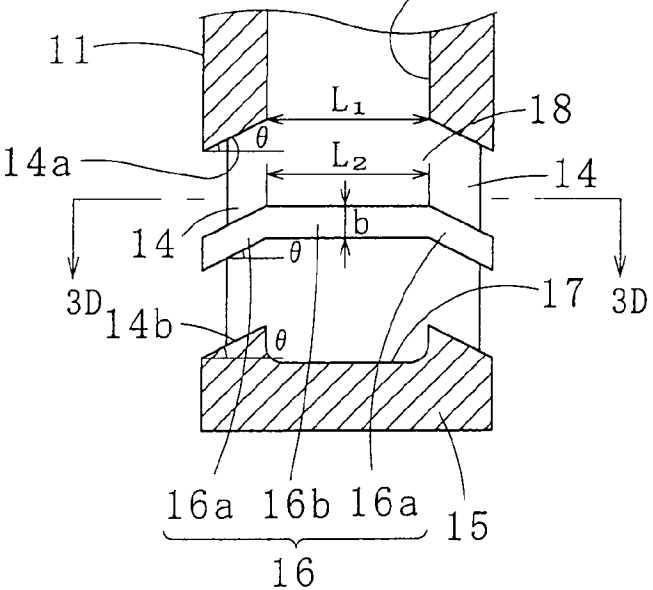
FIG. 3A and FIG. 3B are partial vertical sectional views of the immersion nozzle.
Figure 3D:
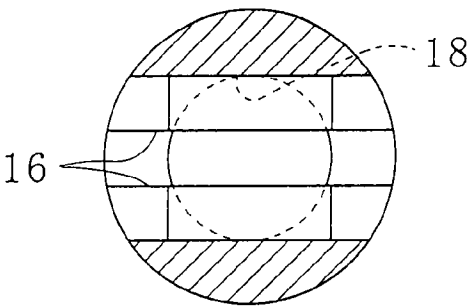
FIG. 3D is a cross-sectional view taken on line 3D-3D of FIG. 3B.
Figure 3A:
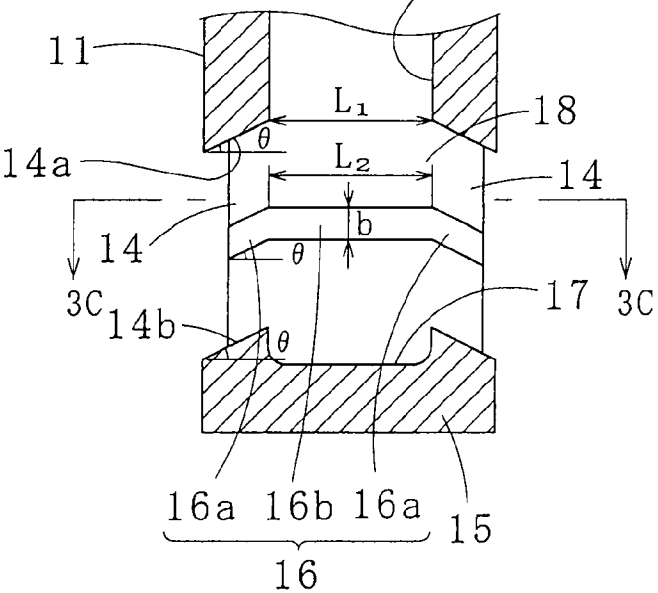
Figure 3C:
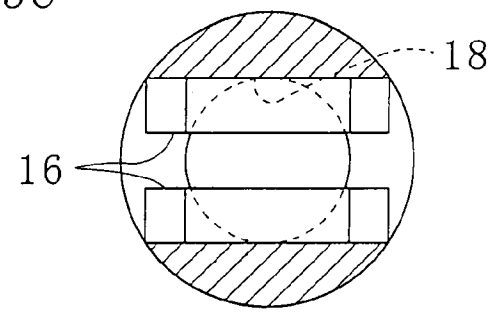
FIG. 3C is a cross-sectional view taken on line 3C-3C of FIG. 3A.

Each of the ridges 16, 16 extends horizontally from one side to the other side in the inner wall 18, i.e., from one border between one outlet 14 and one side in the inner wall 18 to the other border between the other outlet 14 and the other side in the inner wall 18. Preferably, the end faces of each ridge 16 at the opposite ends in the lengthwise direction, i.e., the end faces of the respective tilted portions 16*a*, 16*a*, are vertical faces perpendicular to the lengthwise direction of the ridges 16, 16 as shown in FIG. 3A. When the tubular body 11 is cylindrical, etc, however, the end faces may have a curvature which matches that of the tubular body 11 as shown in FIG. 3B. The end faces having such a curvature do not affect the discharge of molten steel.

Preferably, the tubular body 11 has at the bottom 15 a recessed reservoir 17 for molten steel. Although the absence of the recessed reservoir 17 does not adversely influence the effect of the present invention, the recessed reservoir 17 for molten steel permits more uniform and more stable distribution of molten steel between the outlets 14, 14 by temporarily holding molten steel poured into the immersion nozzle 10.

It does not influence the effect of the present invention whether or not a horizontal width a' of the outlets 14, 14 is the same as the width of the passage 12 (in the case where the passage 12 is cylindrical, the diameter thereof).

Conventional immersion nozzles suffer from discharge of larger amounts of the exit-streams from the lower portions of the outlets, which causes imbalance in flow velocity distribution between the exit-streams that issue from the lower portions and the exit-streams that issue from the upper portions of the outlets. The immersion nozzle 10 according to the embodiment of the present invention, on the other hand, allows sufficient amounts of the exist-streams to issue also from the upper portions due to the effect of the opposing ridges 16, 16 to hold back the molten steel flowing through the immersion nozzle 10. Additionally, due to the effect of the clearance between the ridges 16, 16 to regulate the flow, the molten steel flowing downward through the clearance becomes bilaterally symmetric about the axis of the immersion nozzle 10 when seen in the vertical plane passing through the centers of the respective outlets 14, 14. Further, the immersion nozzle 10 by allowing the exit-streams to uniformly flow out of the entire areas of the outlets 14, 14, reduces the maximum velocities of the exit-streams that impinge on the mold's narrow sidewalls, and in turn, decreases the velocities of the reverse flows. This solves the problems of the level fluctuation at the molten steel surface and the entrapment of mold powder, and thereby prevents lowering of the steel quality.

In addition, the immersion nozzle 10 can be easily manufactured by a method of forming a traditional immersion nozzle because the immersion nozzle 10 is obtained by forming the opposing ridges that protrude into the passage from the inner wall thereof between the pair of outlets.

Examples of methods of forming outlets in a traditional immersion nozzle include: a method comprising forming outlets, of a size smaller than finally intended, in a tubular body, and then boring the outlets perpendicularly to the tubular body to enlarge the outlets and to form ridges of an intended cross sectional dimension; and a method comprising forming recesses, which are parts to be ridges, in a cored bar by CIP (Cold Isostatic Pressing), then charging the recesses with clay, a material used for producing the tubular body, and pressing the clay, thereby forming ridges of an intended cross sectional dimension.

[Water Model Tests]

In order to determine the optimum configuration of the outlets 14, 14 with the ridges 16, 16 therebetween, water model tests were performed using models of the immersion nozzle 10. The water model tests performed will be described in the below.

Figure 2:
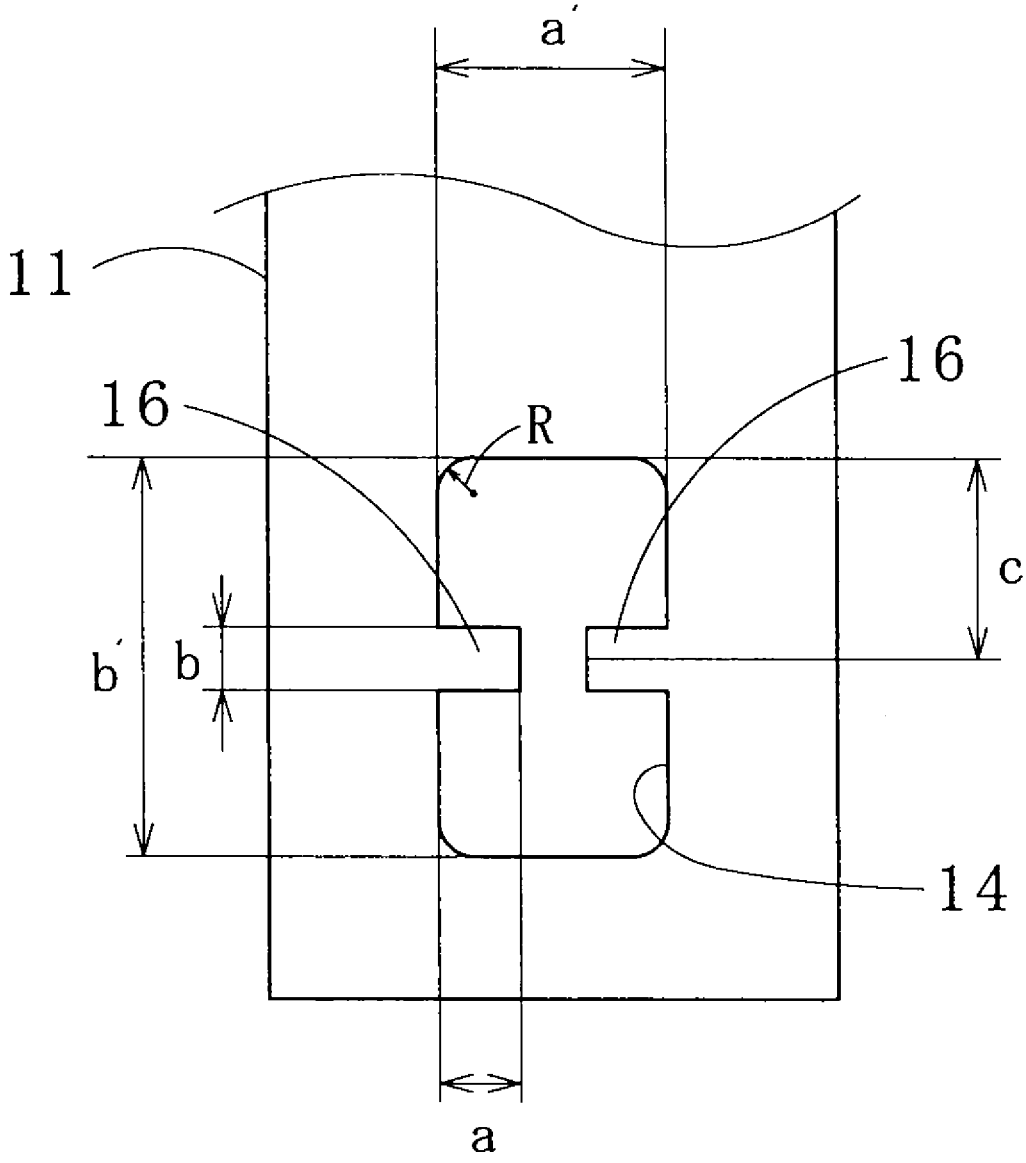
FIG. 2 is a partial side view of the immersion nozzle.

Parameters used to determine the optimum configuration of the outlets 14, 14 with the ridges 16, 16 therebetween are denoted as follows. The horizontal width and vertical length of the outlets 14, 14 as seen in a front view are denoted as a' and b', respectively; the projection height of the ridges 16, 16 at the end faces is denoted as a, the ridges 16, 16 having a substantially rectangular cross section, and the vertical width of the ridges 16, 16 is denoted as b; and the vertical distance between the upper edges of the outlets 14, 14 to the vertical widthwise centers of the ridges 16, 16 is denoted as c (See FIG. 2). The width of the passage 12, in the lengthwise direction of the ridges 16, 16, immediately above the outlets 14, 14 is denoted as $L_1$, and the length of the ridges 16, 16 except the tilted portions 16*a*, 16*a* (i.e., the length of horizontal portions 16*b*, 16*b*) is denoted as $L_2$ (See FIGS. 3A and 3B). The downward tilt angle of the tilted portions 16*a*, 16*a*, the upper end faces 14*a*, 14*a*, and the lower end faces 14*b*, 14*b* is denoted as θ, and the curvature radius of the rounded corners of the outlets 14, 14 is denoted as R.

Figure 4:
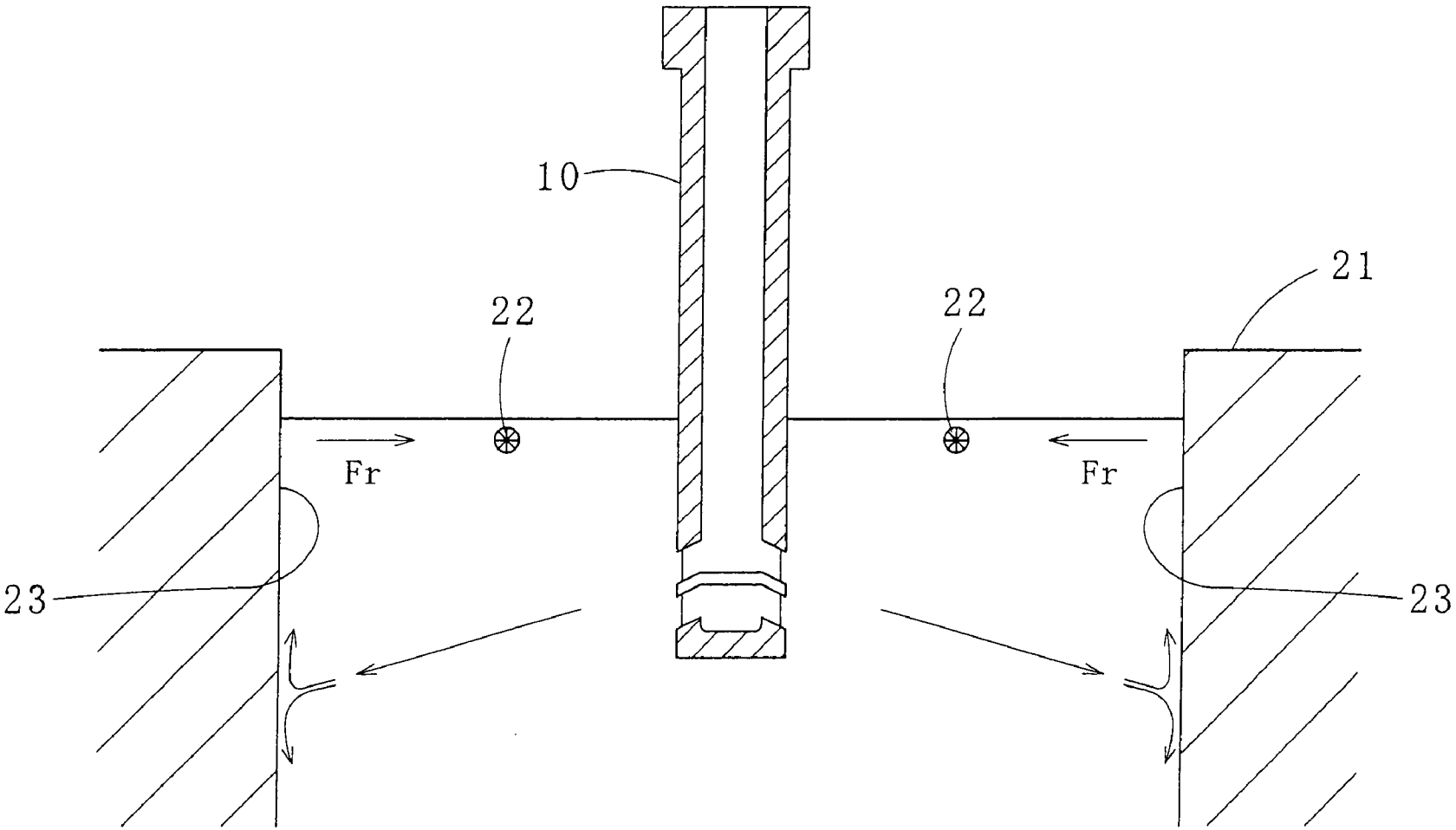
FIG. 4 is a schematic view for explaining water model tests performed using models of the immersion nozzle according to the embodiment of the present invention.

FIG. 4 is a schematic view for explaining the water model tests.

A 1/1 scale mold 21 was made of an acrylic resin. The mold 21 was dimensioned such that the length of the long sides (in FIG. 4, in the left-right direction) was 925 mm and that the length of the short sides (in FIG. 4, in a direction perpendicular to the paper surface) was 210 mm. Water was circulated through the immersion nozzle 10 and the mold 21 by means of a pump at a rate equivalent to a circulation rate of 1.4 m/min.

The immersion nozzle 10 was placed in the center of the mold 21 such that the outlets 14, 14 faced the narrow sidewalls 23, 23 of the mold 21. Propeller-type flow speed detectors 22, 22 were installed 325 mm (¼ of the length of the long sides of the mold 21) off narrow sidewalls 23, 23, respectively, of the mold 21 and 30 mm deep from the water surface. Then, the velocities of the reverse flows Fr, Fr were measured for three minutes. After that, the difference Δσ between standard deviations of the velocities of the right- and left-hand reverse flows Fr, Fr and the average value $V_{av}$ thereof were calculated and the results were evaluated.

Here, a description will be made regarding the correlation between the reverse flows and the throughput.

The water model tests were performed to clarify both the correlation between the difference Δσ between standard deviations of the reverse flows on the right- and left-hand sides of the immersion nozzle and the throughput and the correlation between the average value $V_{av}$ of the velocities of the right- and left-hand reverse flows and the throughput. The results of the water model tests indicated that the values Δσ and $V_{av}$ increased proportionally to the rise in the throughput. The envisaged mold and immersion nozzle for the tests were dimensioned such that the mold had the length of 700 mm to 2000 mm and the width of 150 mm to 350 mm and the passage of the immersion nozzle had the cross sectional area of 15 cm to 120 $cm^2$ (diameter of 50 mm to 120 mm), which dimensions are normally applied in continuous casting of slabs. When the throughput was below 1.4 ton/min, the velocities of the reverse flows at the surface of molten steel were too slow. However, when the throughput was above 7 ton/min, the velocities of the reverse flows were too fast, causing the risk of a reduction in steel quality due to the increased level fluctuation at the surface of the molten steel and due to entrapment of mold powder. Accordingly, it was desirable that the throughput was 1.4 ton/min to 7 ton/min. The test showed that the throughput was within the above-mentioned optimum range when the difference Δσ between the standard deviations of the velocities of the right- and left-hand reverse flows was 2.0 cm/sec or below and when the average value $V_{av}$ of the velocities of the right- and left-hand reverse flows was 10 cm/sec to 30 cm/sec. Accordingly, Δσ of 2.0 cm/sec and below and $V_{av}$ of 10 cm/sec to 30 cm/sec were taken as critical ranges in evaluation of the below-mentioned results of the water model tests performed to determine the optimum configuration of the outlets with the ridges therebetween.

The throughputs in the water model tests were converted using the equation: specific gravity of molten steel/specific gravity of water=7.0. So, the above throughputs are equivalent to the throughputs of molten steel.

Figure 5A:
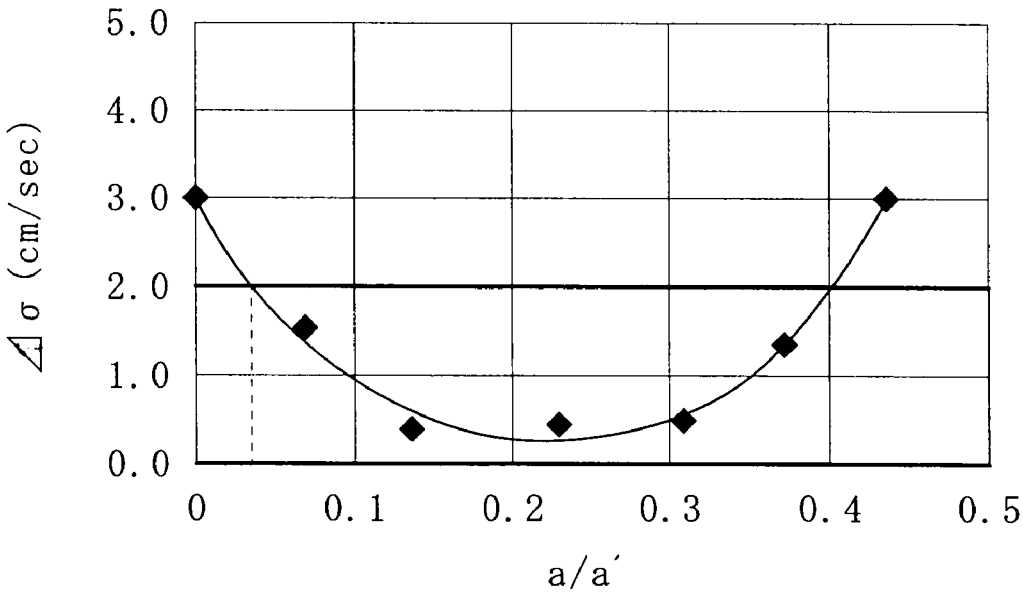
FIG. 5A shows a graph of the relationship between a/a' and $\Delta\sigma$ of the immersion nozzle according to the embodiment of the present invention.
Figure 5B:
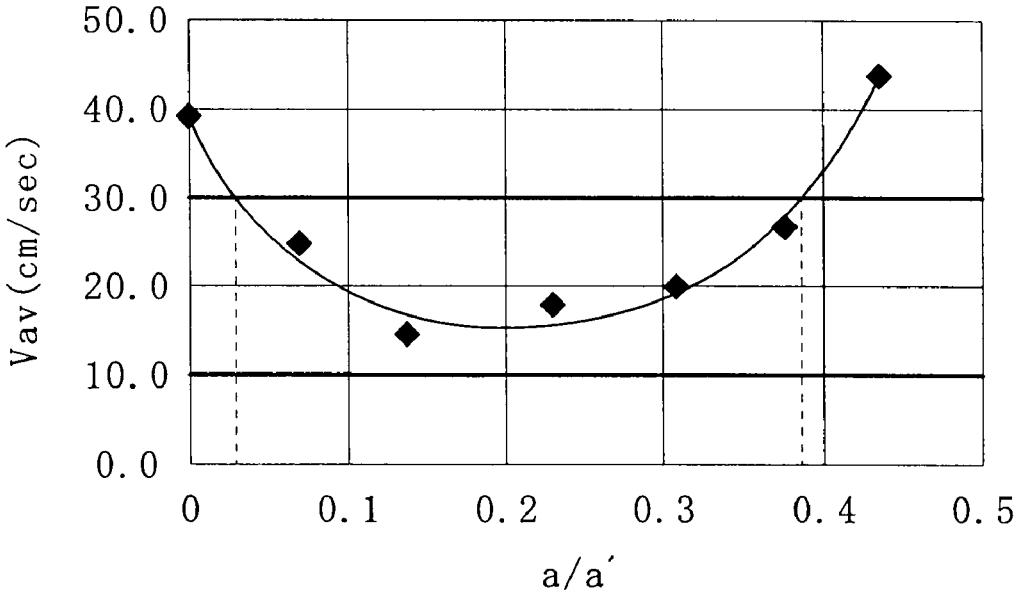
FIG. 5B shows a graph that represents the relationship between a/a' and $V_{av}$ of the immersion nozzle according to the embodiment of the present invention.

FIG. 5A shows a graph that represents the correlation between a/a' and Δσ. FIG. 5B shows a graph that represents the correlation between a/a' and $V_{av}$. In these figures, points ♦ represent individual test measurements and the solid line represents a regression curve, and the representations apply to figures to be mentioned later. FIGS. 5A and 5B indicate that Δσ was 2.0 cm/sec or below and $V_{av}$ was 10 cm/sec to 30 cm/sec when a/a' was within the range of 0.05 to 0.38.

When a/a' was below 0.05, the ridges did not sufficiently exhibit the effects of interrupting and regulating the flow, causing asymmetric streams on the right- and left-hand sides of immersion nozzle in the mold and reverse flows having velocities of beyond 30 cm/sec. This would result in a wide fluctuation in the surface level of the molten steel, and adverse effects such as entrapment of mold powder. On the other hand, when a/a' was beyond 0.38, the exit-streams in the lower portions of the outlets had slightly too low velocities, namely, the exit-streams in the upper portions of the outlets had excessive velocities, and the reverse flows had velocities of beyond 30 cm/sec. This would result in a wide fluctuation in the surface level of the molten steel, and adverse effects such as entrapment of mold powder.

The other parameters used in the present test were set to the following values.

b/b'=0.25, c/b'=0.57, $L_2/L_1$=0.83, θ=15°, R/a'=0.14

Figure 6A:
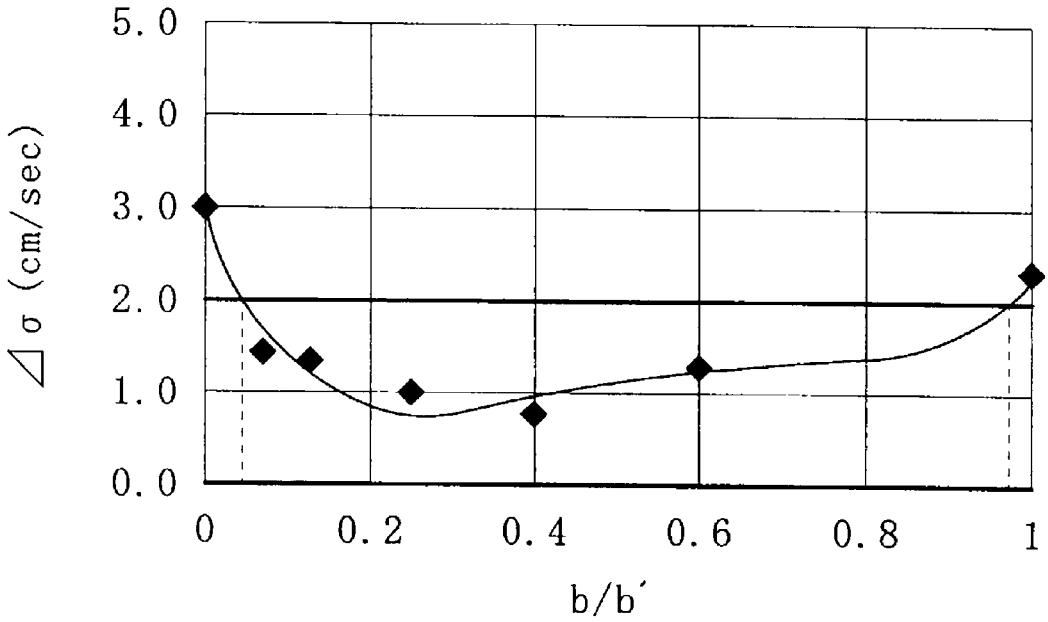
FIG. 6A shows a graph of the relationship between b/b' and $\Delta\sigma$ of the immersion nozzle according to the embodiment of the present invention.
Figure 6B:
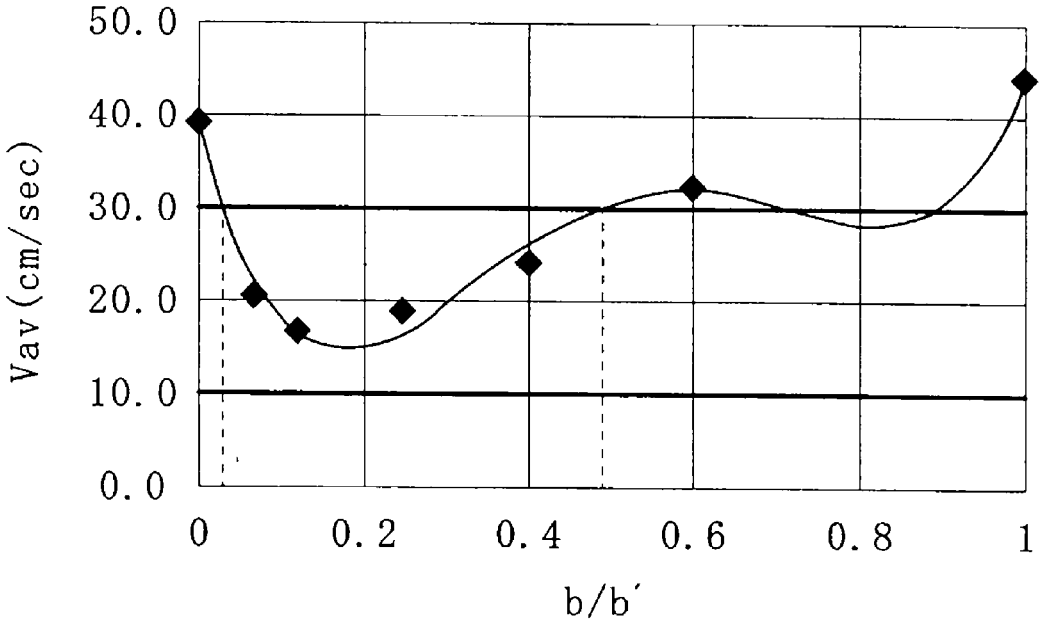
FIG. 6B shows a graph that represents the relationship between b/b' and $V_{av}$ of the immersion nozzle according to the embodiment of the present invention.

FIG. 6A shows a graph that represents the correlation between b/b' and Δσ. FIG. 6B shows a graph that represents the correlation between b/b' and $V_{av}$. These figures indicate that when b/b' was within the range of 0.05 to 0.5, Δσ was 2.0 cm/sec or below and $V_{av}$ was 10 cm/sec to 30 cm/sec.

When b/b' was outside the range of 0.05 to 0.5, the same phenomena would occur as observed when a/a' was outside the range of 0.05 to 0.38: a wide fluctuation in the surface level of the molten steel; and adverse effects such as entrapment of mold powder.

The other parameters used in the present test were set to the following values.

a/a'=0.21, c/b'=0.48, $L_2/L_1$=0.77, θ=15°, R/a'=0.14

Figure 7A:
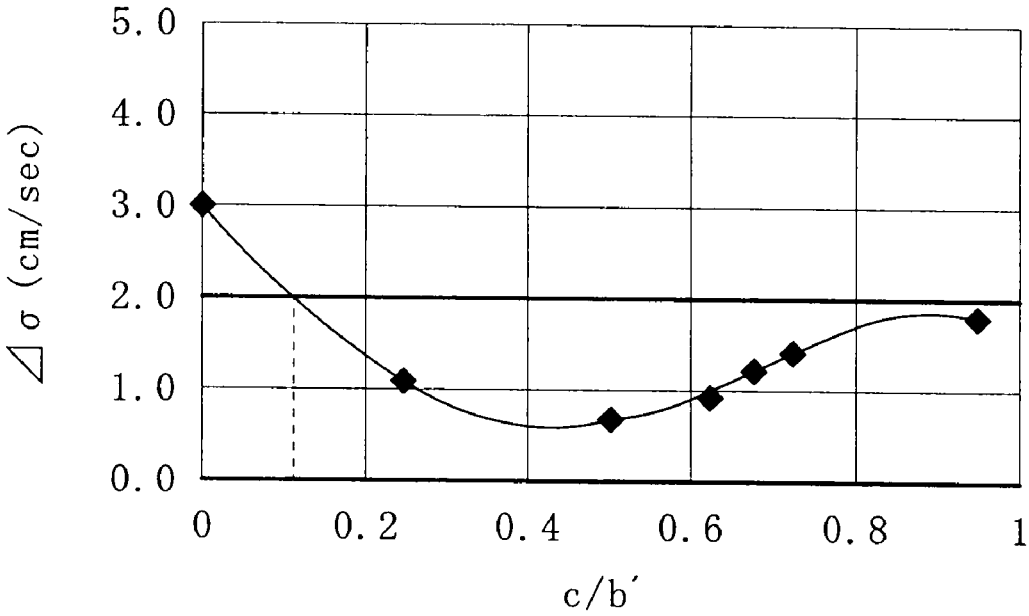
FIG. 7A shows a graph of the relationship between c/b' and $\Delta\sigma$ of the immersion nozzle according to the embodiment of the present invention.
Figure 7B:
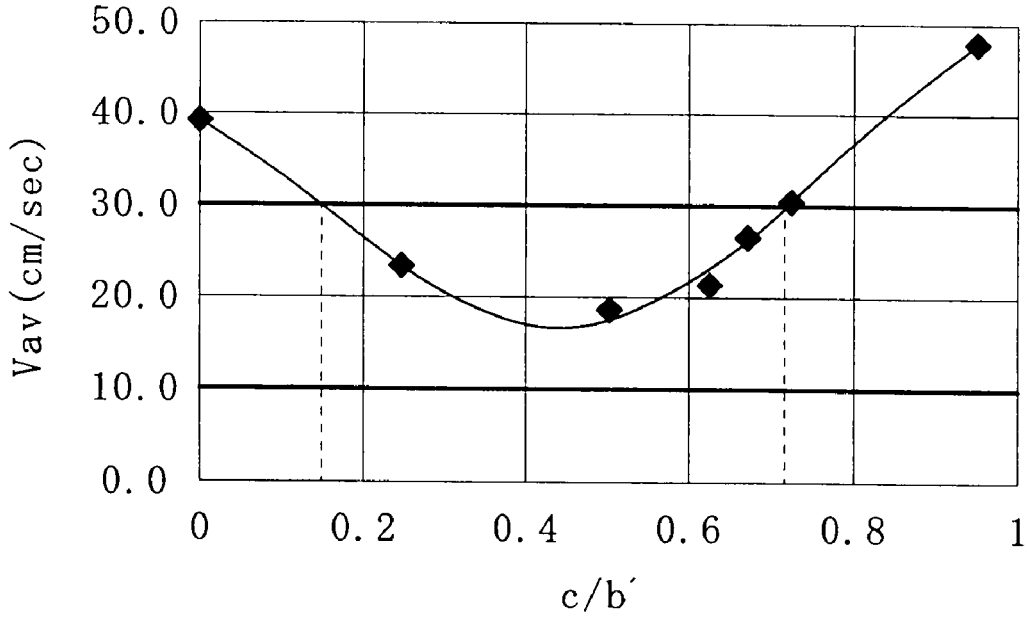
FIG. 7B shows a graph of the relationship between c/b' and $V_{av}$ of the immersion nozzle according to the embodiment of the present invention.

FIG. 7A shows a graph that represents the correlation between c/b' and Δσ. FIG. 7B shows a graph that represents the correlation between c/b' and $V_{av}$. FIG. 7A indicates that Δσ was less sensitive to the change in c/b', while FIG. 7B indicates that $V_{av}$ was 10 cm/sec to 30 cm/sec when c/b' was within the range of 0.15 to 0.7.

When c/b' was outside the range of 0.15 to 0.7, the same phenomena would occur as observed when a/a' was outside the range of 0.05 to 0.38: a wide fluctuation in the surface level of the molten steel; and adverse effects such as entrapment of mold powder.

The other parameters used in the present test were set to the following values.

a/a'=0.24, b/b'=0.25, $L_2/L_1$=0.77, θ=15°, R/a'=0.14

Figure 8A:
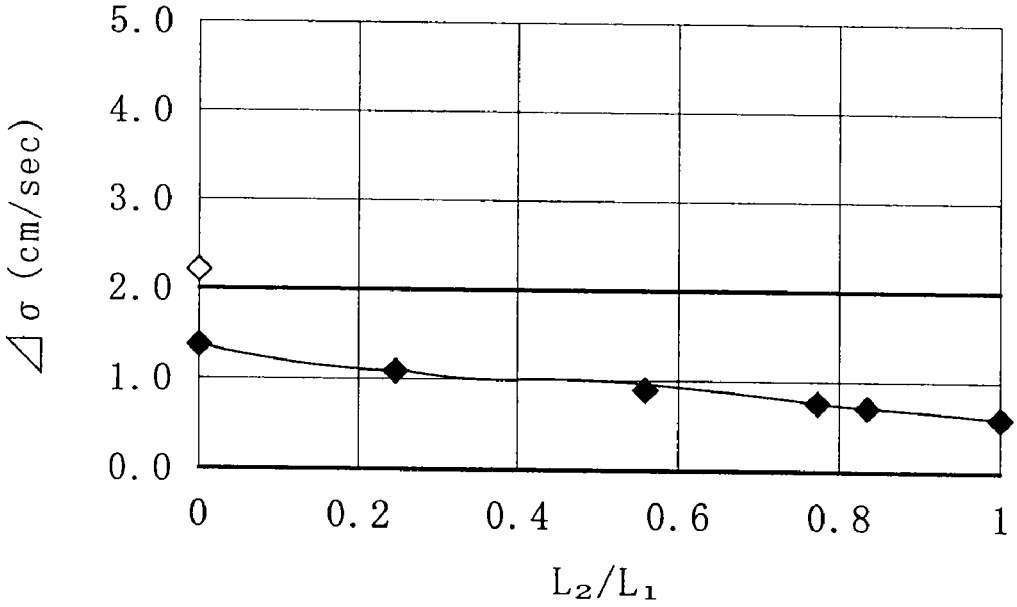
FIG. 8A shows a graph of the relationship between $L_2/L_1$ and $\Delta\sigma$ of the immersion nozzle according to the embodiment of the present invention.
Figure 8B:
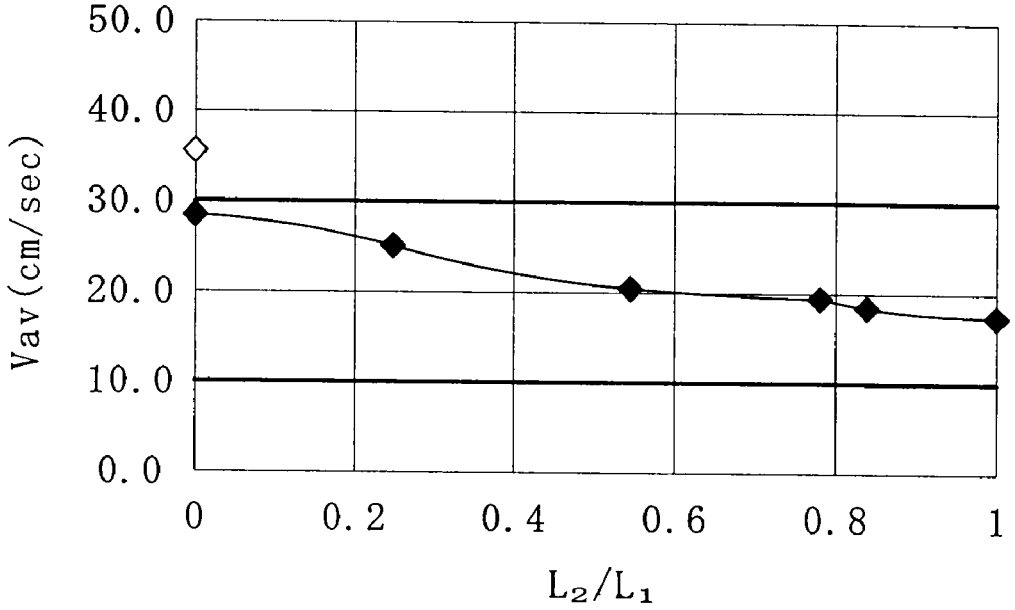
FIG. 8B shows a graph of the relationship between $L_2/L_1$ and $V_{av}$ of the immersion nozzle according to the embodiment of the present invention.

FIG. 8A shows a graph that represents the correlation between $L_2/L_1$ and Δσ. FIG. 8B shows a graph that represents the correlation between $L_2/L_1$ and $V_{av}$. These figures indicate that Δσ was 2.0 cm/sec or below and $V_{av}$ was 10 cm/sec to 30 cm/sec when $L_2/L_1$ was within the range of 0 to 1.

$L_2/L_1$=0 means $L_2$=0, namely, that the ridges 16, 16 are inverted V-shaped with no horizontal portions 16*b*, 16*b*. On the other hand, when $L_2/L_1$ was above 1, manufacture of the immersion nozzle would be difficult.

In FIGS. 8A and 8B, points ◇ represent measurements of individual tests serving as comparative tests using a nozzle having no ridges.

The other parameters used in the present test were set to the following values.

a/a'=0.29, b/b'=0.25, c/b'=0.5, θ=15°, R/a'=0.14

Figure 9A:
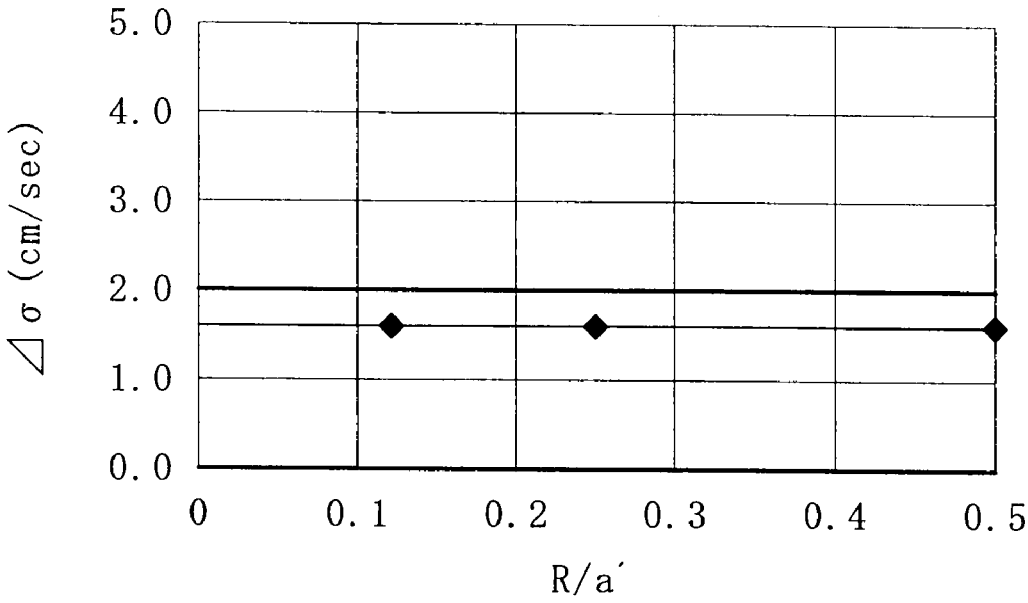
FIG. 9A shows a graph of the relationship between R/a' and $\Delta\sigma$ of the immersion nozzle according to the embodiment of the present invention.
Figure 9B:
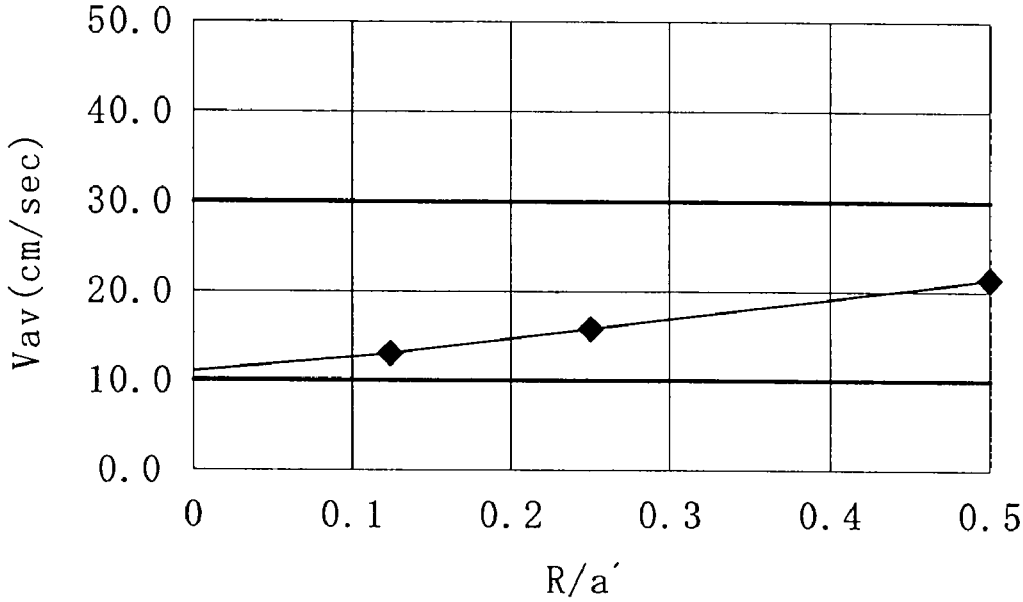
FIG. 9B shows a graph of the relationship between R/a' and $V_{av}$ of the immersion nozzle according to the embodiment of the present invention.

FIG. 9A shows a graph that represents the correlation between R/a' and Δσ. FIG. 9B shows a graph that represents the correlation between R/a' and $V_{av}$. R/a'=0.5 means that the outlets are elliptical or circular in shape. FIG. 9A indicates that as R/a' increased, Δσ increased only slightly but did not change greatly. On the other hand, FIG. 9B indicates that with the increasing R/a' and thus with the decreasing outlet area, $V_{av}$ increased, but that $V_{av}$ was within the range of 10 cm/sec to 30 cm/sec. Thus, the test proved that the ridges were effective even when the rounded corners of the outlets had a large curvature radius.

The mold used in the present test had dimensions of 1500 mm×235 mm and the throughput was 3.0 ton/min.

The other parameters used in the present test were set to the following values.

a/a'=0.13, b/b'=0.25, c/b'=0.4, $L_2/L_1$=1, θ=0°

Table 1 shows the results of water model tests performed using the immersion nozzles for continuous casting according to the embodiment of the present invention, one nozzle having the reservoir for molten steel in the bottom of the tubular body, the other having no reservoir. Table 1 indicates that Δσ and $V_{av}$ did not vary greatly depending on the presence or absence of the reservoir and were in the optimum ranges.

The other parameters used in the present test were set to the following values. The mold had dimensions of 1200 mm×235 mm and the throughput was 2.4 ton/min.

a/a'=0.14, b/b'=0.33, c/b'=0.5, $L_2/L_1$=1, θ=0°, R/a'=0.14

TABLE 1

| | With reservoir | Without reservoir |
|---|---|---|
| Δσ (cm/sec) | 1.17 | 1.32 |
| $V_{av}$ (cm/sec) | 26.3 | 28.4 |

[Fluid Analysis]

A description will be made regarding the fluid analyses on the exit-streams from the immersion nozzle for continuous casting according to the embodiment of the present invention and those from an immersion nozzle according to prior art.

Figure 10A:
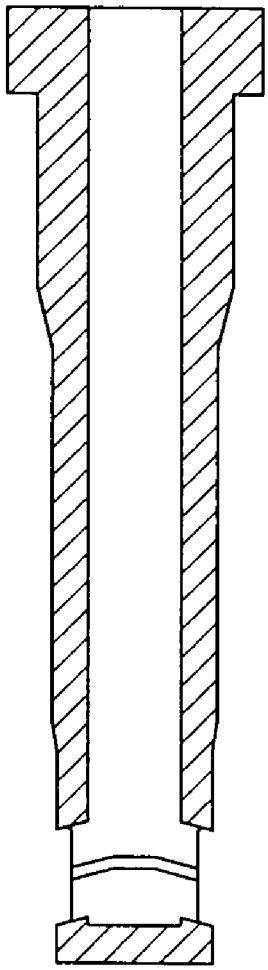
FIG. 10A is a schematic view of a simulation model, used in fluid analysis, of the immersion nozzle according to the embodiment of the present invention.
Figure 10B:
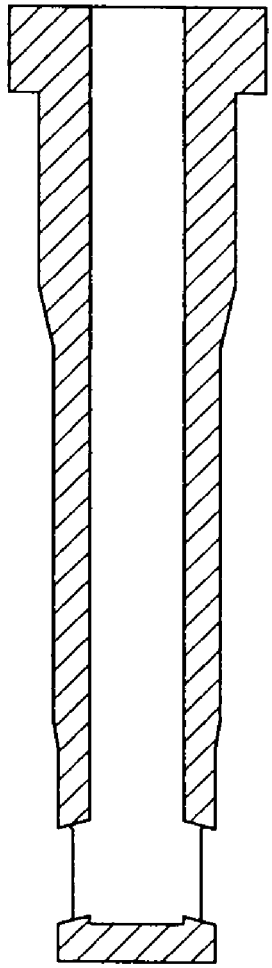
FIG. 10B is a schematic view of a simulation model, used in fluid analysis, of an immersion nozzle according to prior art.

The fluid analyses were performed by using FLUENT (fluid analysis software) manufactured by Fluent Asia Pacific Co., Ltd. (i.e., ANSYS Japan K.K. at present). FIG. 10A shows a simulation model of the immersion nozzle according to the embodiment of the present invention, while FIG. 10B shows a simulation model of an immersion nozzle according to prior art. The nozzle used in the analyses according to the prior art included a cylindrical body with a bottom, and a pair of opposing outlets. The pair of opposing outlets were disposed in the sidewall at a lower section of the body so as to communicate with the passage. The immersion nozzle according to the embodiment of the present invention was obtained by providing the conventional nozzle with opposing ridges. The following are the values of their parameters: a/a'=0.13, b/b'=0.13, c/b'=0.43, $L_2/L_1$=0.68, θ=15°.

The analyses were performed on the assumption that the mold was 1540 mm long and 235 mm wide and that the throughput was 2.7 ton/min.

Figure 11A:
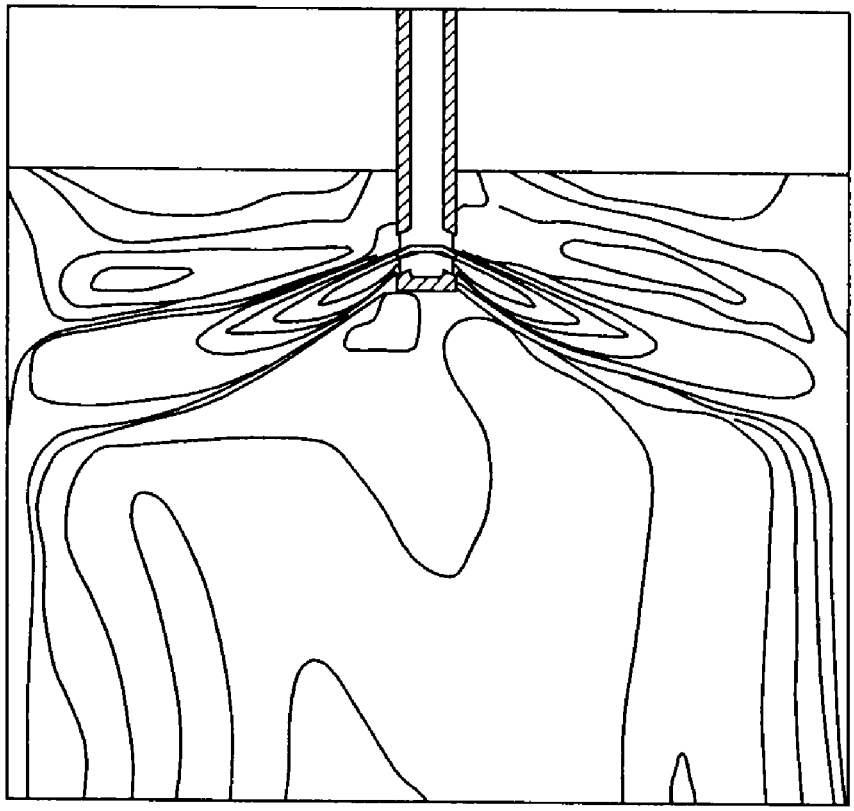
FIG. 11A and FIG. 11B show fluid flow patterns as seen in a vertical plane and a horizontal plane, respectively, both obtained as the result of fluid analysis performed using the simulation model of the immersion nozzle according to the embodiment of the present invention.
Figure 11B:
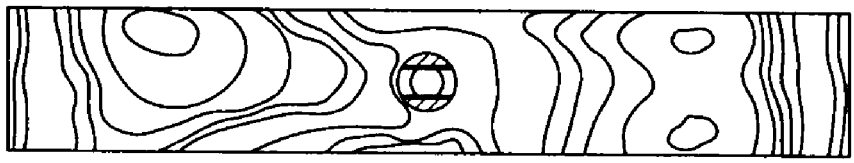
Figure 12A:
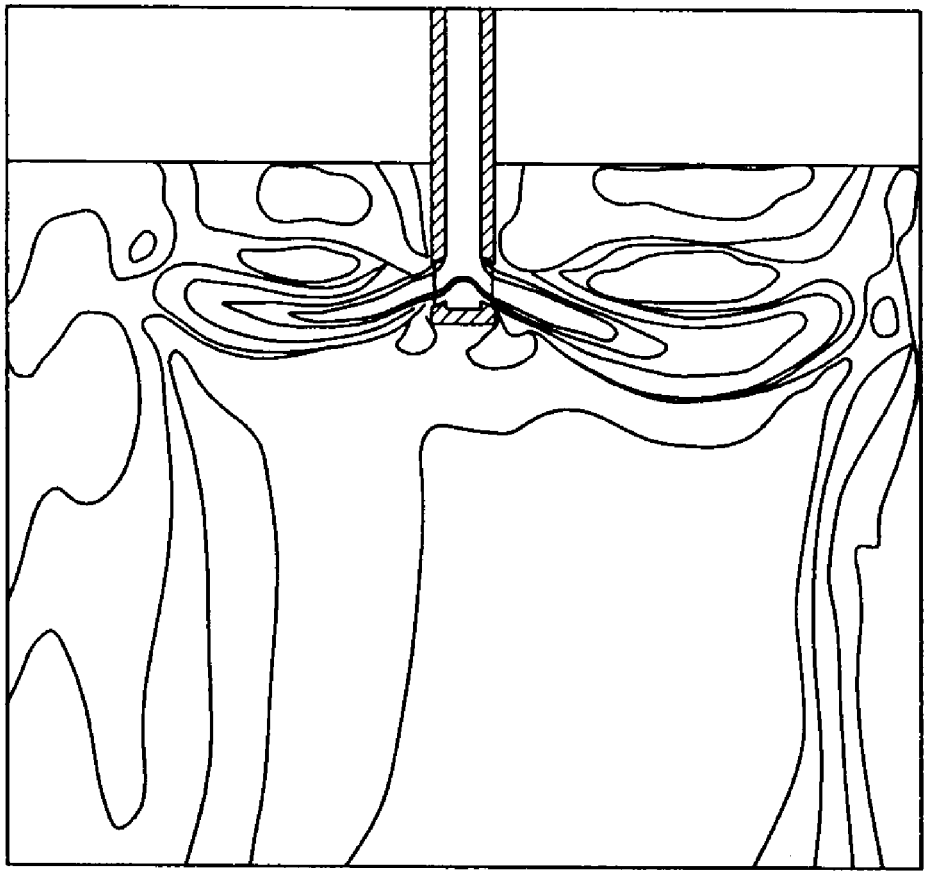
FIG. 12A and FIG. 12B show fluid flow patterns as seen in a vertical plane and a horizontal plane, respectively, both obtained as the result of fluid analysis performed using the simulation model of the immersion nozzle according to the prior art.
Figure 12B:
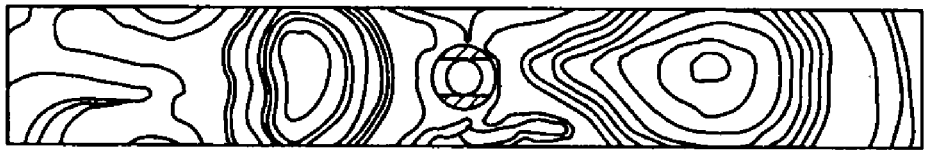

FIGS. 11A and 11B present the results of the fluid analyses using the simulation model according to the embodiment of the present invention. FIGS. 12A and 12B present the results of the fluid analyses using the simulation model according to prior art. These figures indicate that the simulation model according to the embodiment of the present invention reduced drifts in the right- and left-hand exit-streams in the mold, lowered the velocities of the reverse flows at the molten steel surface, and as a result, decreased the level fluctuation at the molten steel surface, as compared to the simulation model according to prior art. This improves the quality of slabs and the production efficiency of high-speed casting of slabs.

Figure 13:
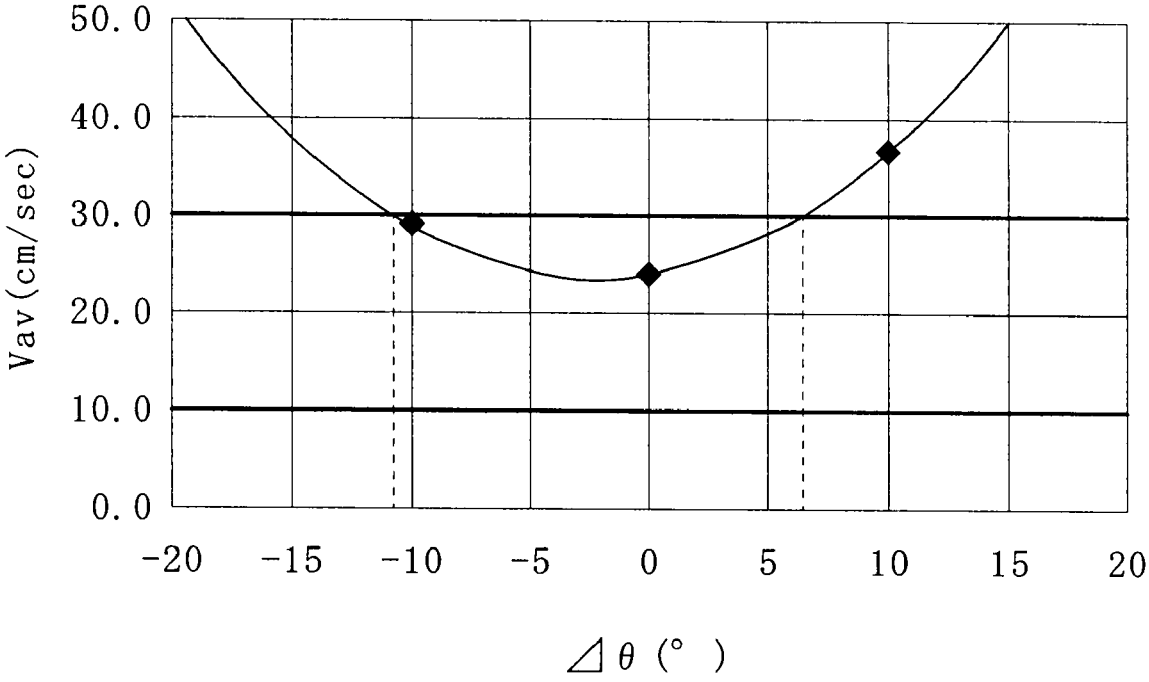
FIG. 13 shows a graph of the relationship between $\Delta\theta$ and $V_{av}$ of the immersion nozzle according to the embodiment of the present invention.

FIG. 13 shows a graph that represents a variation in the average value $V_{av}$ relative to the difference Δθ. The average value $V_{av}$ is the average value of the velocities of the right- and left-hand reverse flows that was calculated by the fluid analyses. The difference Δθ is the difference between the tilt angle of the tilted portions of the ridges and the tilt angle of the upper end faces and lower end faces of the outlets. When Δθ is a negative value, the tilted portions of the ridges are less tilted than the upper end faces and lower end faces of the outlets. FIG. 13 indicates that $V_{av}$ was smallest when Δθ was zero, i.e., when the tilted portions of the ridges had the same tilt angle as the upper end faces and lower end faces of the outlets. FIG. 13 also shows that $V_{av}$ was within the range of 10 cm/sec to 30 cm/sec when Δθ ranged from −10° to +7°, and the velocities of reverse flows were favorable.

Regarding the immersion nozzle for continuous casting according to the embodiment of the present invention, further study was made by fluid analyses on changes in the exit-streams caused by varying the tilt angle of the tilted portions of the ridges and that of the upper end faces and lower end faces of the outlets on condition that the tilted portions and the upper end faces and lower end faces had the same tilt angle. The results of the fluid analyses are shown in FIGS. 14A to 17B. The following are the values of the parameters used in the fluid analyses.

Figure 14A:
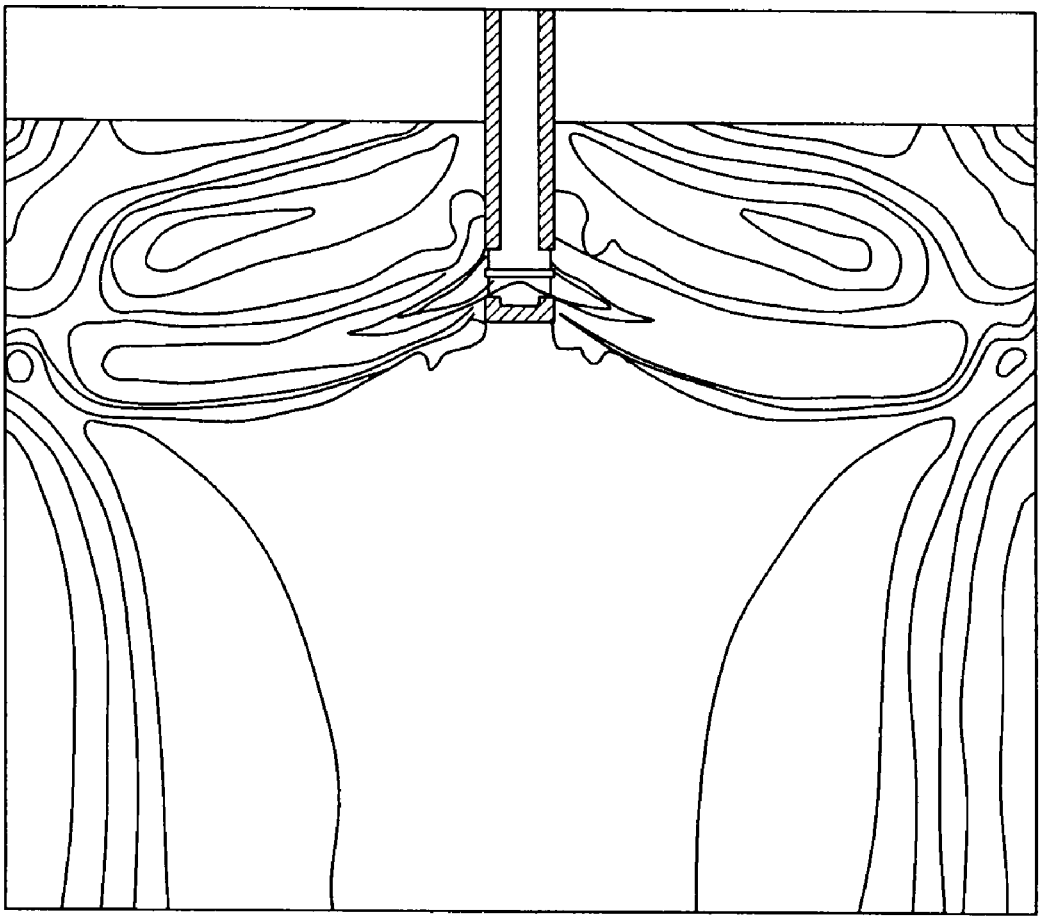
FIG. 14A and FIG. 14B show fluid flow patterns as seen in a vertical plane and a horizontal plane, respectively, both obtained as the result of fluid analysis ($\theta$=0°) performed using the simulation model of the immersion nozzle according to the embodiment of the present invention.
Figure 14B:
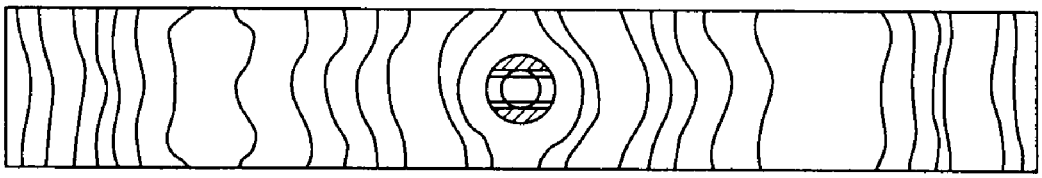
Figure 15A:
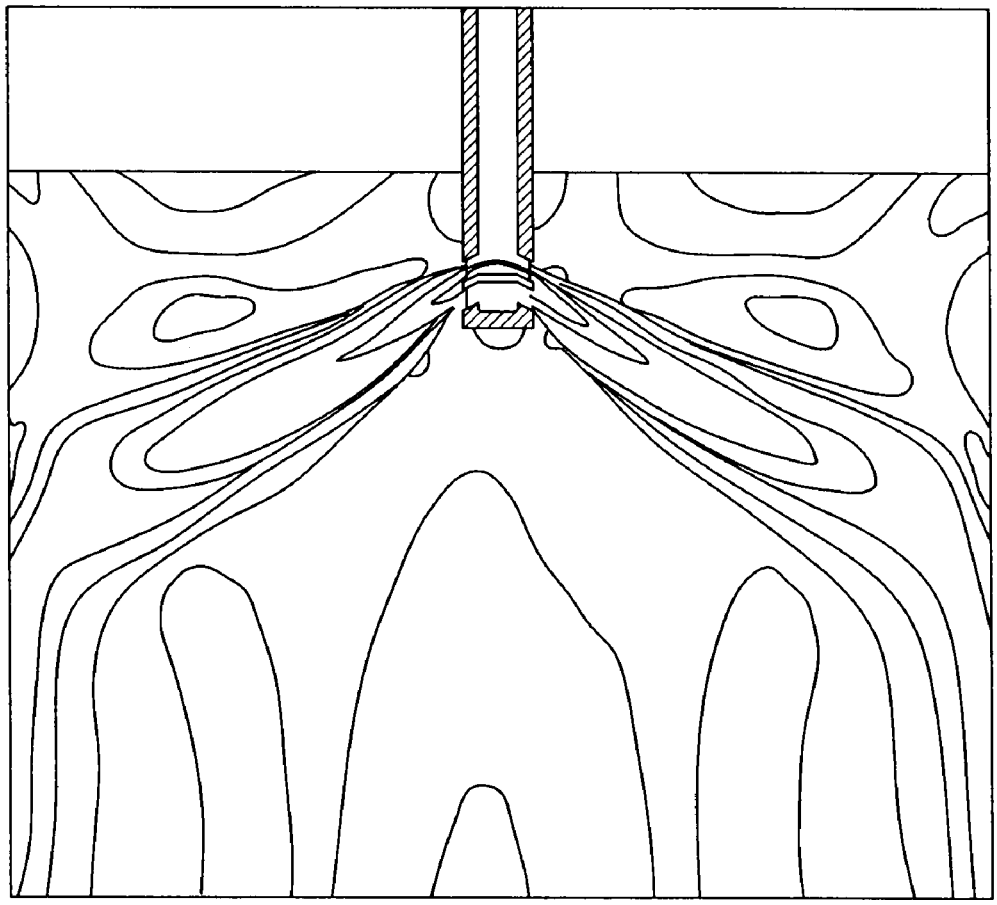
FIG. 15A and FIG. 15B show fluid flow patterns as seen in a vertical plane and a horizontal plane, respectively, both obtained as the result of fluid analysis ($\theta$=25°) performed using the simulation model of the immersion nozzle according to the embodiment of the present invention.
Figure 15B:
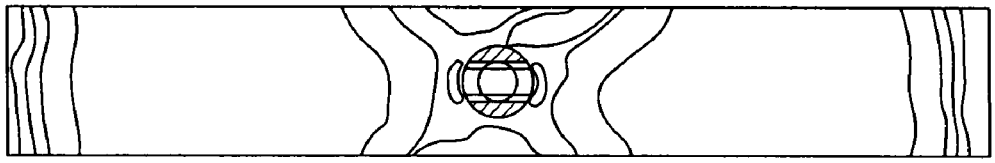
Figure 16A:
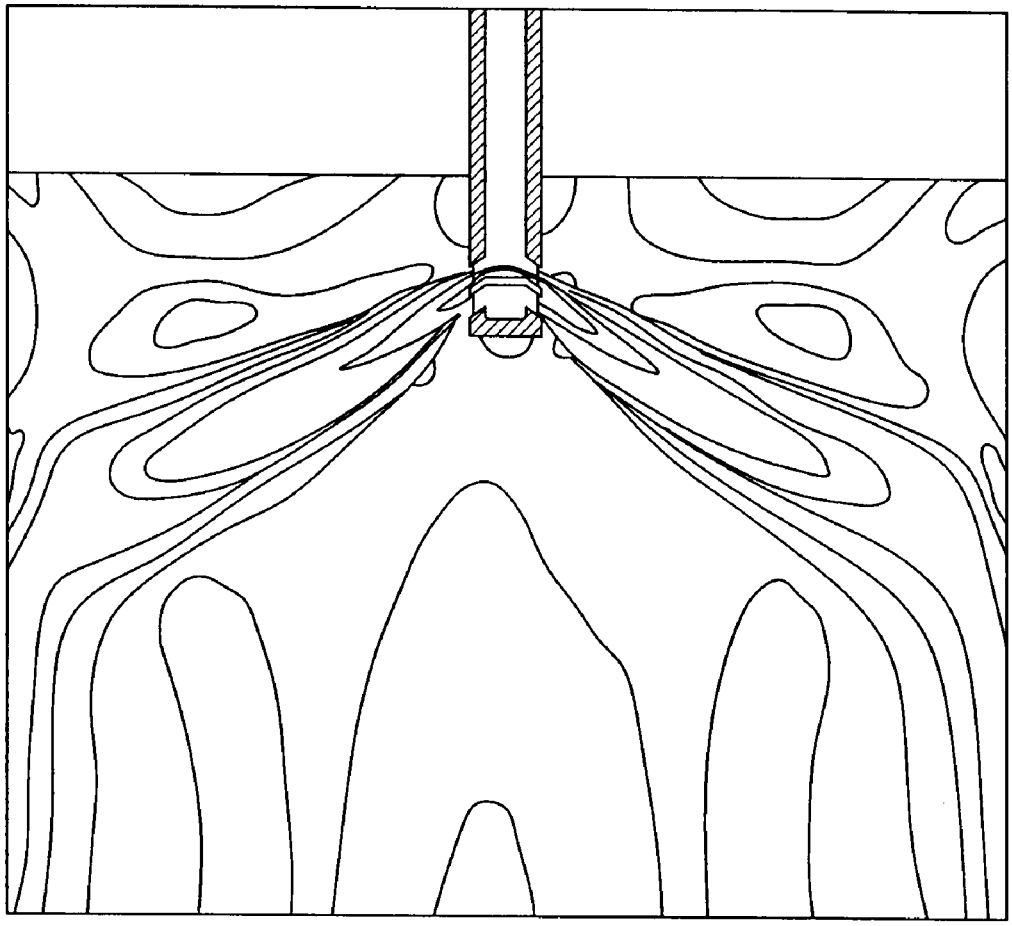
FIG. 16A and FIG. 16B show fluid flow patterns as seen in a vertical plane and a horizontal plane, respectively, both obtained as the result of fluid analysis ($\theta$=35°) performed using the simulation model of the immersion nozzle according to the embodiment of the present invention.
Figure 16B:
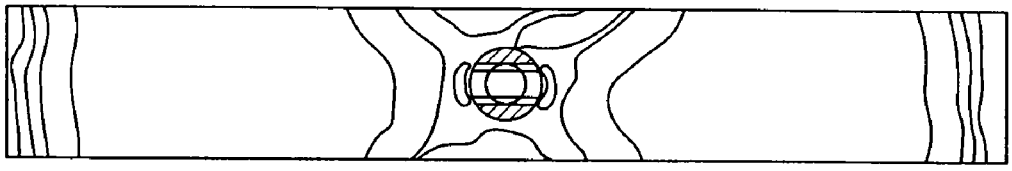
Figure 17A:
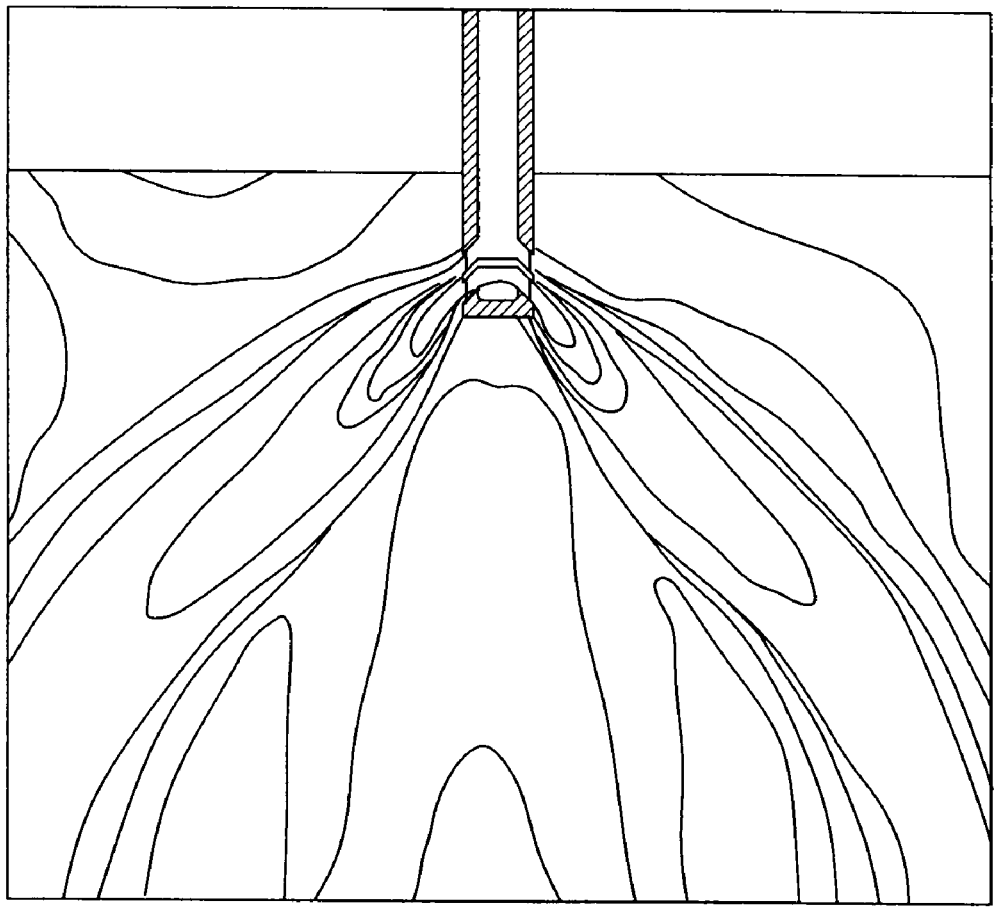
FIG. 17A and FIG. 17B show fluid flow patterns as seen in a vertical plane and a horizontal plane, respectively, both obtained as the result of fluid analysis (θ=45°) performed using the simulation model of the immersion nozzle according to the embodiment of the present invention.
Figure 17B:
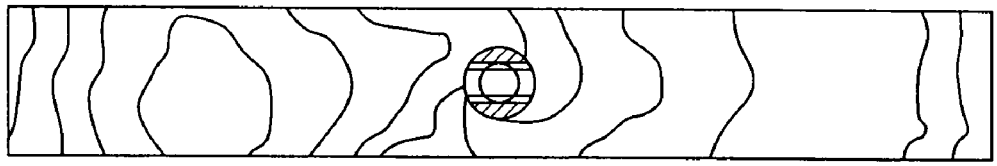
Figure 18A:
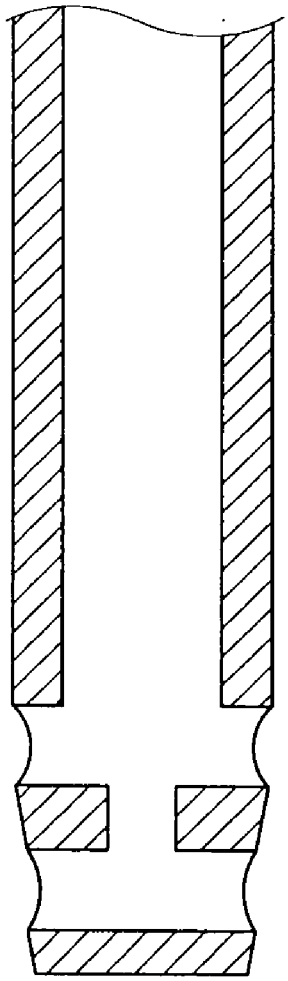
FIG. 18A and FIG. 18B are cross sectional views of an immersion nozzle for continuous casting according to International publication No. 2005/049249.
Figure 18B:
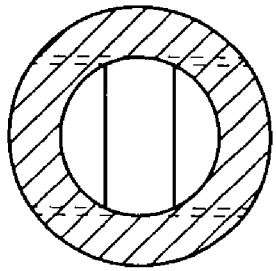
Figure 19:
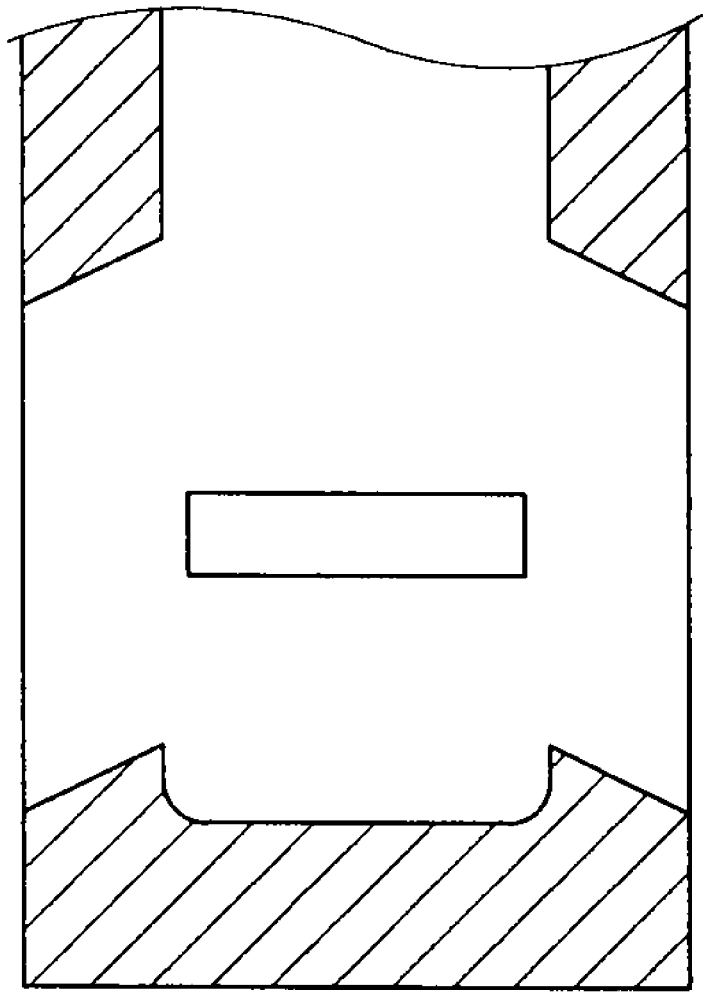
FIG. 19 is a partial vertical sectional view of an immersion nozzle including ridges projecting into the passage between the opposing outlets.
Figure 20A:
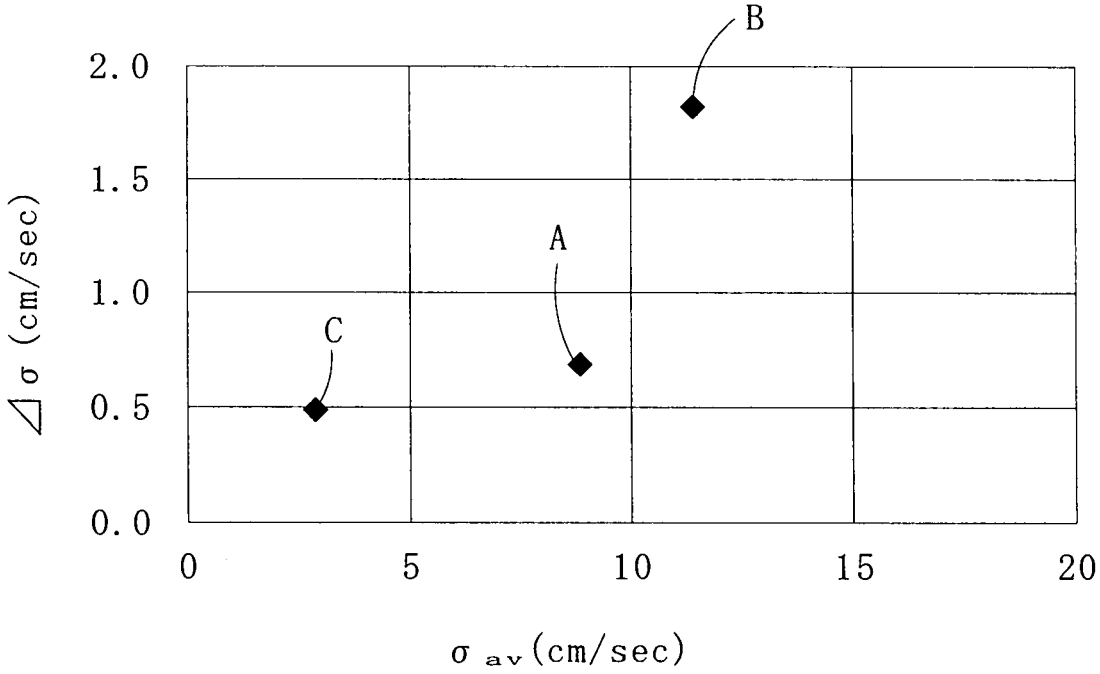
FIG. 20A and FIG. 20B show graphs that represent the relationship between $\sigma_{av}$ and Δσ, and the relationship between $\sigma_{av}$ and $V_{av}$, respectively.
Figure 20B:
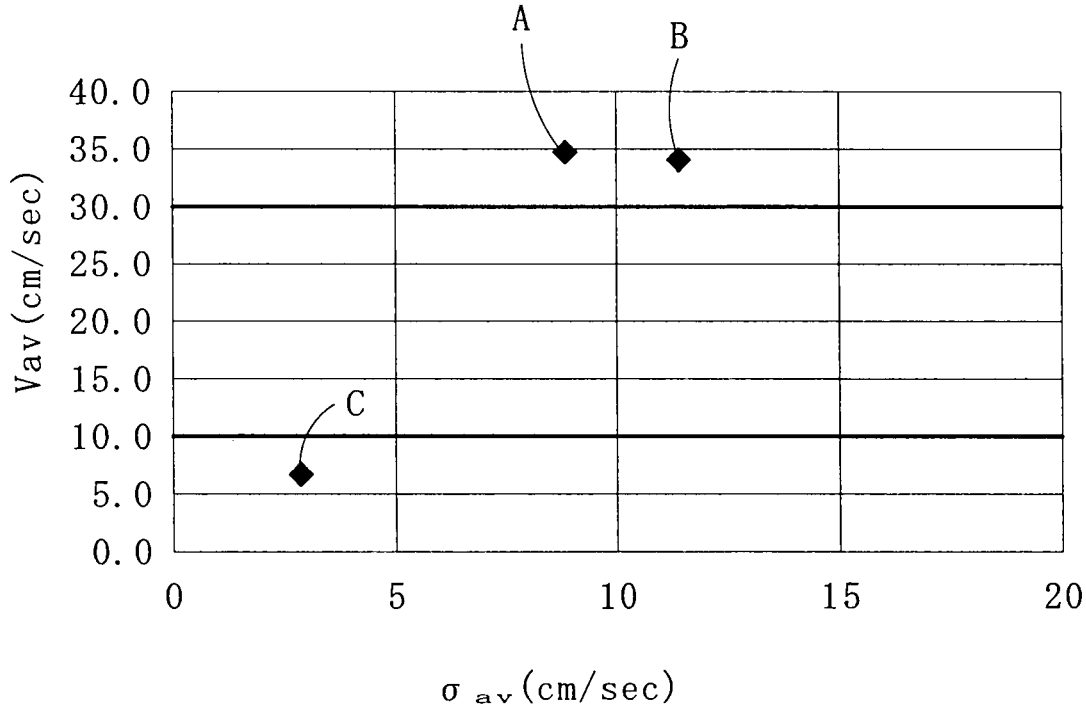
Figure 21A:
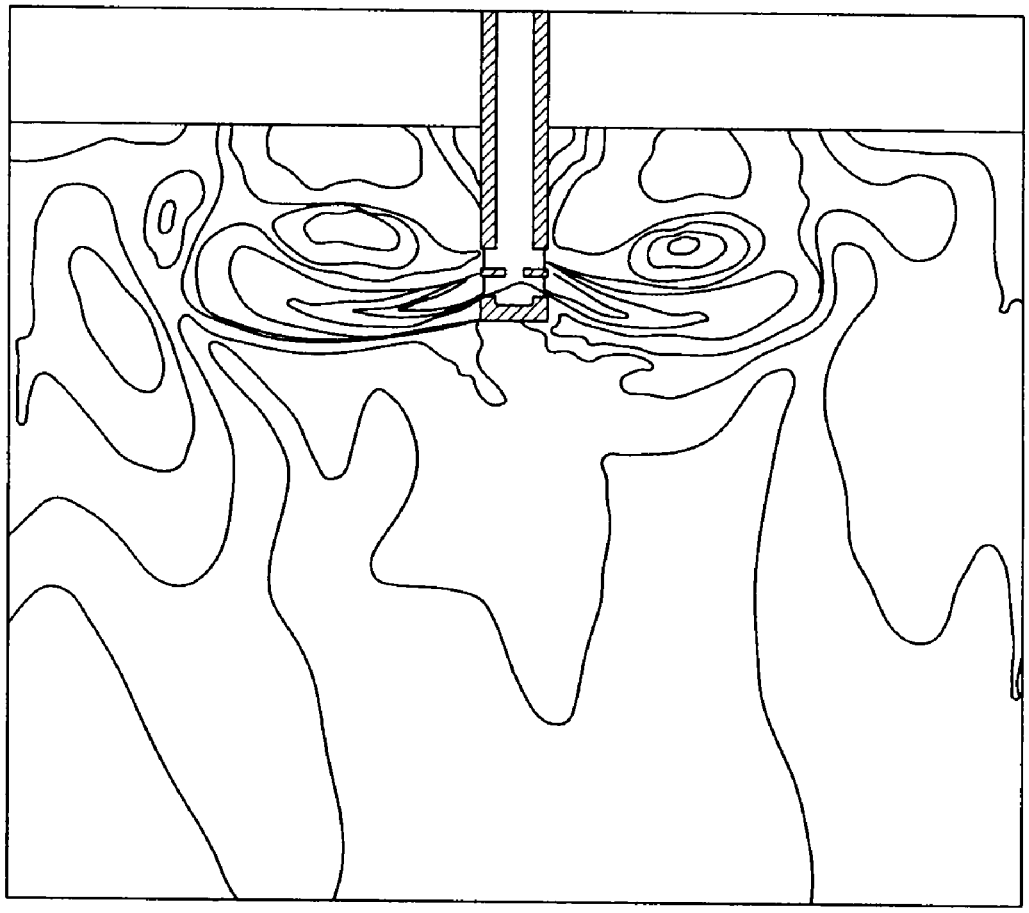
FIG. 21A and FIG. 21B show fluid flow patterns as seen in a vertical plane and a horizontal plane, respectively, both obtained as the result of fluid analysis performed using the simulation model of the immersion nozzle according to International publication No. 2005/049249.
Figure 21B:
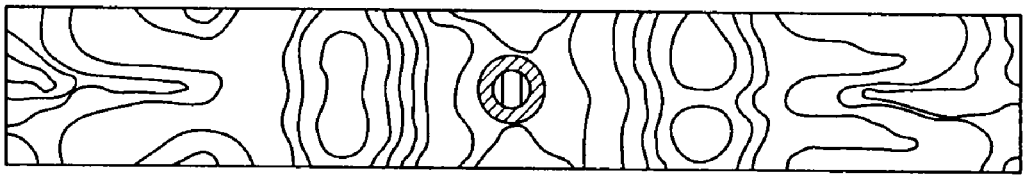

FIGS. 14A and 14B: a/a'=0.13, b/b'=0.25, c/b'=0.4, $L_2/L_1$=1, θ=0°, throughput=3.0 ton/min FIGS. 15A and 15B: a/a'=0.13, b/b'=0.13, c/b'=0.43, $L_2/L_1$=0.68, θ=25°, throughput=2.7 ton/min FIGS. 16A and 16B: a/a'=0.13, b/b'=0.13, c/b'=0.43, $L_2/L_1$=0.68, θ=35°, throughput=2.7 ton/min FIGS. 17A and 17B: a/a'=0.13, b/b'=0.13, c/b'=0.43, $L_2/L_1$=0.68, θ=45°, throughput=2.7 ton/min The results of the fluid analyses shown in FIGS. 14A to 17B and the results of the aforementioned fluid analyses with θ=15° shown in FIGS. 11A and 11B indicate that the drifts in the exit-streams in the mold were reduced and also the velocities of the reverse flows at molten steel surface were decreased when the tilt angle ranged from 0° to 45°.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An immersion nozzle for continuous casting, comprising:

a tubular body with a bottom, the tubular body having an inlet for entry of molten steel disposed at an upper end and a passage extending inside the tubular body downward from the inlet, a pair of opposing outlets disposed in a sidewall at a lower section of the tubular body so as to communicate with the passage; and a pair of opposing ridges horizontally projecting into the passage from an inner wall between the pair of outlets, the inner wall defining the passage, wherein each of the ridges extends from a border between one outlet and a side of the inner wall to another border between the opposite outlet and an opposite side of the inner wall.

2. The immersion nozzle of claim 1, wherein a/a' ranges from 0.05 to 0.38 and b/b' ranges from 0.05 to 0.5, where a' and b' are a horizontal width and a vertical length, respectively, of the outlets in a front view; a is a projection height of the ridges at end faces; and b is a vertical width of the ridges.

3. The immersion nozzle of claim 2, wherein c/b' ranges from 0.15 to 0.7, where c is a vertical distance between upper edges of the outlets in a front view and vertical widthwise centers of the ridges.

4. The immersion nozzle of claim 1, wherein the ridges each have tilted portions at opposite ends in a lengthwise direction of the ridges, the tilted portions tilted downward toward an outside of the tubular body.

5. The immersion nozzle of claim 4, wherein each outlet has an upper end face and a lower end face that are tilted downward toward the outside of the tubular body at the same tilt angle as the tilted portions.

6. The immersion nozzle of claim 5, wherein $L_2/L_1$ ranges from 0 to 1, where $L_1$ is a width of the passage, along a lengthwise direction of the ridges, immediately above the outlets; and $L_2$ is a length of the ridges except the tilted portions.

7. The immersion nozzle of claim 6, wherein the upper end faces and lower end faces of the outlets and the tilted portions of the ridges are tilted at a tilt angle of 0° to 45°.

8. The immersion nozzle of claim 1, wherein the ridges each have end faces at opposite ends in a lengthwise direction of the ridges, the end faces being vertical faces perpendicular to the lengthwise direction of the ridges.

9. The immersion nozzle of claim 1, wherein the tubular body has at a bottom a recessed reservoir for molten steel.

* * * * *